US008786390B2

(12) United States Patent
Luckey et al.

(10) Patent No.: US 8,786,390 B2
(45) Date of Patent: Jul. 22, 2014

(54) POWER TRANSFORMER WITH AMORPHOUS CORE

(75) Inventors: Michael Luckey, Marsberg (DE); Wolfgang Mönig, Brilon (DE); Benjamin Weber, Winterberg (DE); Karel Bilek, Brisbane (AU); Martin Carlen, Niederrohrdorf (DE); Jong-Yun Lim, Sudkorea (KR)

(73) Assignee: ABB Technology AG, Zurich (CH)

( * ) Notice: Subject to any disclaimer, the term of this patent is extended or adjusted under 35 U.S.C. 154(b) by 17 days.

(21) Appl. No.: 13/248,645

(22) Filed: Sep. 29, 2011

(65) Prior Publication Data

US 2012/0068800 A1 Mar. 22, 2012

Related U.S. Application Data

(63) Continuation of application No. PCT/EP2010/001796, filed on Mar. 23, 2010.

(30) Foreign Application Priority Data

Apr. 11, 2009 (EP) ..... 09005285

(51) Int. Cl.

| | |
|---|---|
| ***H01F 30/12*** | (2006.01) |
| ***H01F 27/29*** | (2006.01) |
| ***H01F 27/24*** | (2006.01) |
| ***H01F 27/28*** | (2006.01) |

(52) U.S. Cl.

USPC ..... 336/5; 336/192; 336/213; 336/220

(58) Field of Classification Search

USPC ..... 336/5, 220, 213, 192

See application file for complete search history.

(56) References Cited

U.S. PATENT DOCUMENTS

| | | | | |
|---|---|---|---|---|
| 5,396,210 | A * | 3/1995 | Purohit et al. | 336/60 |
| 6,326,877 | B1 | 12/2001 | Hay et al. | |
| 6,374,480 | B1 | 4/2002 | Rand | |
| 6,873,239 | B2 * | 3/2005 | Decristofaro et al. | 336/178 |
| 2001/0033216 | A1 * | 10/2001 | Shirahata et al. | 336/5 |
| 2003/0112111 | A1 * | 6/2003 | Bolotinsky et al. | 336/170 |
| 2004/0108926 | A1 * | 6/2004 | Hopkinson et al. | 336/5 |

FOREIGN PATENT DOCUMENTS

| | | | |
|---|---|---|---|
| CN | 1783371 | A | 6/2006 |
| DE | 20 54 567 | A1 | 5/1972 |
| DE | 29 34 719 | A1 | 3/1980 |

(Continued)

OTHER PUBLICATIONS

International Search Report (PCT/ISA/210) issued on Jun. 29, 2010, by European Patent Office as the International Searching Authority for International Application No. PCT/EP2010/001796.

*Primary Examiner* — Tsz Chan

(74) *Attorney, Agent, or Firm* — Buchanan Ingersoll & Rooney PC

(57) ABSTRACT

A transformer of dry design is disclosed having a core composed of amorphous material, which is sensitive to mechanical loads, having at least one winding former which surrounds the core and is in each case formed from at least one primary winding and secondary winding, and having at least one holding apparatus. A method for transformer production is also disclosed, wherein the holding apparatus is used to fix the at least one primary winding and secondary winding in each case and for this purpose it acts on each of the end faces of the at least one winding former.

9 Claims, 2 Drawing Sheets

(56) References Cited

FOREIGN PATENT DOCUMENTS

| | | | |
|---|---|---|---|
| EP | 1 298 680 | A2 | 4/2003 |
| EP | 1298680 | A2 * | 4/2003 |
| JP | 56-066022 | A | 6/1981 |
| JP | 58-164205 | A | 9/1983 |
| WO | WO 00/77801 | A1 | 12/2000 |

* cited by examiner

POWER TRANSFORMER WITH AMORPHOUS CORE

RELATED APPLICATIONS

This application claims priority as a continuation application under 35 U.S.C. §120 to PCT/EP2010/001796, which was filed as an International Application on Mar. 23, 2010 designating the U.S., and which claims priority to European Application 09005285.3 filed in Europe on Apr. 11, 2009. The entire contents of these applications are hereby incorporated by reference in their entireties.

FIELD

The disclosure relates to a power transformer of dry design having, for example, a core which can be in the form of a winding strip core and composed of amorphous material, which is sensitive to mechanical loads, having at least one winding former which can surround the core and is in each case formed from at least one primary winding and secondary winding, and having at least one holding apparatus.

BACKGROUND INFORMATION

Transformers are used for power transmission for power supply purposes, by adapting the voltage from a first voltage level to a second. Power transformers of dry design, so-called dry transformers, are being increasingly used instead of power transformers with an oil filling, as were previously widely used.

In this case, the configuration of a power transformer of dry design is very similar to that of a power transformer with an oil filling to the extent that the respective winding formers are also fitted to cores composed of ferromagnetic material in a power transformer of dry design, which cores are each connected to yokes at both ends, and form a magnetic circuit.

However, in the case of dry transformers, the heat losses which were absorbed by the oil in the case of power transformers with an oil filling and were emitted via suitable cooling surfaces or separate coolers, are dissipated by air convection. With the lower specific heat capacity of the air in comparison to oil, the power of dry transformers can be restricted.

Resistive losses occur in the windings of a loaded transformer because of the winding currents and eddy currents in the conductor material. These resistive losses have no-load losses superimposed on them, and possibly short-circuit losses as well as hysteresis losses.

The no-load losses are governed primarily by the induction and the nature of the core and are approximately independent of the operating temperature of the transformer. The short-circuit losses are temperature-dependent and rise with the temperature and the specific resistivity of the conductor material, if the load is constant. Core materials having a very low hysteresis loop can therefore be used in order to keep the hysteresis losses as low as possible.

In order to reduce the heat losses caused in this way in a dry transformer, and thus to improve its load capability, amorphous core material has recently been used, rather than grain-oriented core material.

However, the use of amorphous materials can involve new designs and processing forms since the amorphous material is highly pressure-sensitive, as a result of which this can result in an increase in the core losses.

SUMMARY

A transformer is disclosed of dry design having a core including an amorphous material that is sensitive to mechanical loads, comprising: at least one winding former which surrounds the core and is in each case formed from at least one primary winding and secondary winding; and at least one holding apparatus, wherein the holding apparatus is used to fix the at least one primary winding and secondary winding in the each case, and the holding apparatus acts on each end face of the at least one winding former.

A method for production of a transformer is disclosed having a winding strip core including an amorphous material that is sensitive to mechanical loads, at least one winding former which surrounds the core and is in each case formed from at least one primary winding and secondary winding, and at least one holding apparatus, the method comprising: producing a strip material from amorphous material; winding an annular core with the same cross section in each case from the amorphous strip material; placing two rectangular individual cores with their longitudinal limbs against one another; winding the strip material around the individual cores in a winding plane of the individual cores, such that the winding plane has three longitudinal limbs with a same cross section; providing outer limbs of the transformer core with at least one of the electrical lower-layer winding or the electrical upper-layer winding; and connecting the electrical windings.

BRIEF DESCRIPTION OF THE DRAWINGS

The disclosure, advantageous refinements and improvements of the disclosure as well as exemplary advantages of the disclosure will be explained and described in more detail with reference to an exemplary embodiment of the disclosure which is illustrated in the attached drawing, in which.

DETAILED DESCRIPTION

Figure 1:
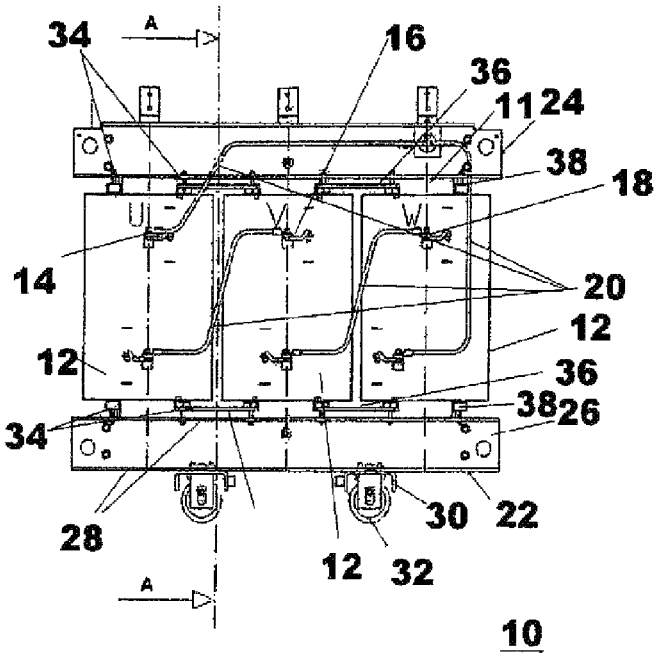
FIG. 1 shows a side view of an exemplary transformer with complete electrical wiring.

A power transformer is disclosed whose physical design can be chosen so as to more completely exploit advantages of the amorphous core material without the pressure load in consequence increasing the core losses.

The disclosure provides that a core composed of amorphous material can be held suspended by a holding apparatus, wherein the holding apparatus is used to fix an at least one primary winding and secondary winding in each case and for this purpose it acts on each of the end faces of the at least one winding former.

In this case, one development of the disclosure provides that the amorphous core can be produced as a winding strip core composed of strip material of amorphous material.

In this case, the laminate windings which are prepared for use as cores are preferably held in shape by means of a tear-resistant strip, by looping the tear-resistant strip repeatedly around the laminate stack repeatedly, with the loops at a distance from one another, thus holding the laminate winding together. The winding strip cores formed in this way can, for example, have a rectangular outline, that is to say they each enclose a rectangular area. However, refinements with an oval or circular outline are also covered within the disclosure.

According to an exemplary embodiment of the disclosure, the transformer can be in the form of a polyphase transformer and has three cores which are arranged alongside one another and are each surrounded by a winding or coil former.

For this purpose, at least two winding strip cores are arranged with their longitudinal limbs alongside one another and, in order to connect them mechanically, strip material composed of amorphous material is wound around them in the winding plane, with all the limbs having the same winding cross section, that is to say they have the same thickness and width.

In other words, in one exemplary development, the longitudinal limbs of at least two (for example, four), of the winding strip cores mentioned above are placed against one another. Strip material composed of amorphous material is then wound around the arrangement formed in this way, with this winding process resulting in a total of five limbs with the same winding cross section.

According to a further exemplary embodiment, a transformer can be characterized in that the holding apparatus is formed from at least two clamping elements, which are operatively connected to one another and are arranged on each of the end faces of a winding former. In this case, the holding structure is designed such that mechanical stresses which occur during the fixing of the winding formers are introduced exclusively into the holding structure and into the winding formers, as a result of which the cores which can be surrounded by the winding formers can be guided in the holding structure but they might not be braced, that is to say they might not be subject to mechanical stresses.

According to an exemplary alternative refinement of the disclosure, it is possible for each core to be formed in a cylindrical shape from amorphous material with a layer structure, with at least two limbs and a yoke integrally formed at one end.

The clamping elements of the holding structure can, for example, be composed of ferromagnetic material, and may at the same time be used as a yoke.

In this case, it has been found to be advantageous in exemplary embodiments for each core to be magnetically conductively connected to the clamping elements of the holding apparatus. For this purpose, each core is surrounded at each end on two opposite sides by the clamping elements and without pressure, with the clamping elements being held exactly at a distance from the respective core by means of spacers which are firmly connected to the clamping elements, in order to avoid a pressure load on the core as a result of the core being clamped in and the mechanical load resulting from this.

One end of the respective core is in this case inserted at the intended location into the free space between the clamping elements and is held by means of a supporting plate, which can be likewise firmly connected to the clamping elements, as a result of which, for example in the case of a transformer according to the disclosure in the form of a polyphase transformer, three cores can be arranged in the form of pillars alongside one another on the lower holding apparatus, which is used as the lower yoke, possibly engaging in the intermediate space bounded by the two clamping elements, while avoiding mechanical stresses.

However, according to an exemplary embodiment variant of the disclosure, it is also possible for the holding structure to be composed of non-ferromagnetic material, in particular of fiber-reinforced plastics. In this case, although the holding structure is not part of the magnetic field circuit, the entire arrangement, however, has considerably lower weight than an entirely-metal version for this purpose.

According to a further embodiment of the transformer according to the disclosure, the end faces of each core are provided with a coating composed of insulating material. This coating is used on the one hand as electrical insulation and on the other hand as means for shock absorption for the relevant core. This coating is, for example, composed of an insulating material, such as plastic, in particular glass-fiber-reinforced plastic or silicon rubber.

According to a further exemplary embodiment variant of the transformer according to the disclosure, supports which connect the yokes to one another, that is to say, the lower yoke to the upper yoke, are provided on the end faces of each yoke. For example, these supports are passed along the external longitudinal sides of the core or of the cores and are surrounded by the relevant winding former, that is to say the supports are passed through in the interior of the winding former, parallel to the respective core, and are connected to the opposite yoke.

In addition, tie rods can be provided which press the yokes formed from the clamping elements against the winding formers, without any adverse effect on any of the cores.

In summary, it can be stated that the disclosure provides for a pressed coil structure to be used rather than a previously normal pressed core structure in which the coil or winding formers are fixed by pressing against the core. In consequence, the winding formers are held by means of a holding structure, independently of the core. The core can be placed or suspended on plates of the holding structure provided for this purpose.

In addition to protection of the novel design of a transformer with a so-called hanging core in a pressed coil or winding structure, the object of the present disclosure is also to specify a method for producing this novel transformer, specifically a transformer having a core which is composed of layered strips of amorphous material, which is sensitive to mechanical loads, having at least one winding former which surrounds the core and is in each case formed from at least one primary winding and secondary winding, and having at least one holding apparatus.

Accordingly, an exemplary method for producing a transformer can be characterized by the features listed below, in for example the stated sequence:

a) strip material is produced from amorphous material;
b) an annular core with the same (e.g., rectangular) cross section is in each case produced by winding from the amorphous strip material;
c) two rectangular individual cores are placed with their longitudinal limbs against one another and the strip material is wound around them in the winding plane of the individual cores, such that it has three longitudinal limbs with the same cross section; (in this instance and in the description that follows, "winding plane" is understood to mean the plane in which the winding of the respective individual core takes place.)
d) the outer limbs of the transformer core produced in this way are each provided with the electrical lower-layer winding or with the electrical upper-layer winding; and
e) the electrical windings are then connected.

In this case, the short limbs of the winding rings can each form the magnetic yokes. Oval or circular cross sections can also be used for the cross section of the individual winding rings, rather than the rectangular shape.

Alternatively, it is possible for the transformer core to be formed from a total of four windings with longitudinal limbs which are arranged alongside one another and are mechanically connected to one another, thus in this way producing a five-limb core. In this case as well, the mechanical connection, as already indicated above for the three-limbed core, is for example produced by strip material being wound around the individual cores on the winding plane thereof thus resulting in the individual cores being assembled to form a five-limb core.

According to an exemplary embodiment variant, it is expedient for mats composed of silicone rubber to be arranged on the end faces of each core for shock absorption and electrical insulation purposes.

FIG. 1 shows a side view of an exemplary transformer 10 according to the disclosure with complete electrical external wiring which, as a polyphase transformer, can in each case have one core 11 in three winding formers 12, whose upper electrical connections 14, 16, 18 in the illustrated example are identified by U, V, W, and are conductively connected to one another by means of connecting conductors 20.

The three winding formers 12 can be arranged close to one another, alongside one another, in a line and are held between a lower yoke 20 and an upper yoke 22.

Each yoke 20, 22 can be composed of in each case two clamping elements 25, which can each be in the form of a C-profile, that is to say they are formed from a web part 26 with flanges 28 which are integrally formed at right angles and face the same side on the longitudinal sides thereof. The clamping elements 24 are arranged parallel to one another, such that the flanges 28 face outward, while their rear faces, where there are no flanges, face one another.

In the illustrated example, the flanges have a different width, to be precise such that those flanges 28 which are located on sides of the winding formers 12 are narrower than those which are on the side facing away from the winding formers 12 and which are approximately twice as wide. This configuration has been found to be particularly advantageous for the clamping elements 25 of the lower yoke 22 since the broader flanges 28 ensure a correspondingly larger footprint area, and therefore greater stability.

Those flanges 28 of the clamping elements 25 which in each case face the winding formers 12 can be used for attachment of the winding formers 12 and therefore for force introduction when the yokes 22, 24 are braced. Furthermore, cross-members 30 are fitted to the lower flange 28 of the lower yoke 20, and rollers 32 are attached to the outer ends of these cross-members 30, on which rollers 32 the complete transformer 10 can be moved, as can also be seen from the view in FIG. 2.

The winding formers 12 are supported on the lower yoke 20 by lateral supports 34, which are composed of electrically non-conductive material and are preferably used as glass-fiber-reinforced plates 36 and strips 38. These lateral supports 34 are connected on the one hand to the upper flange 28 of the lower yoke 20, and on the other hand to the respective winding formers 12 placed on them.

This method of attachment can be repeated in a corresponding manner on the upper face of the transformer 10. In this case as well, lateral supports 34 are arranged in a corresponding manner in order to anchor the winding formers 12, which lateral supports 34 are formed from plates 36 and strips 38, both of which are each composed of electrically non-conductive material, with the lateral supports 34 being provided for rigid connection of the winding formers 12 to the lower flange 28 of the upper yoke 22.

Figure 2:
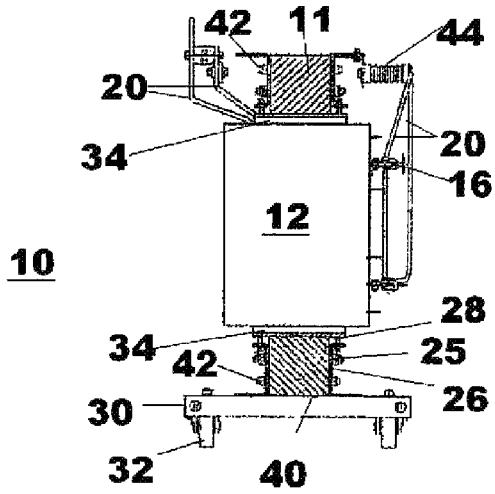
FIG. 2 shows an exemplary section view along the section line A-A in FIG. 1.

In FIG. 2, which shows a cross section through the transformer 10 as shown in FIG. 1, along the section line A-A illustrated there, the transformer 10 according to the disclosure is shown looking at a winding former 12 from the side.

For example, this view differs from the view shown in FIG. 1 in the view of the core 11 of amorphous material, which is held or suspended in the lower yoke 22 and the upper yoke.

As already stated elsewhere, when amorphous materials are used for production of transformer cores, care should be taken to ensure that the core material is not subject to any mechanical load, for example from pressure, since this causes an increase in the core losses.

For this reason, the lower flanges 28 of the clamping elements 25 which form the lower yoke 22 can be provided with a supporting plate 40, on which the respective core 11 rests. In addition, tie rods 42 can in each case be provided, which pass through the clamping elements 25 of the lower yoke 22 and of the upper yoke 24 and the core 11, thus helping to ensure that the core 11 is held in an interlocking manner.

An insulator, which can be used to hold the connecting conductor 20, can be fitted to an upper flange 28 of a clamping element 25, in the illustrated example of the right-hand clamping element 25, of the upper yoke 24. Connecting conductors, which can be connected to at least one of the winding formers 12, are likewise shown on the opposite, left-hand side of the upper yoke 24 in the illustrated example.

Figure 3:
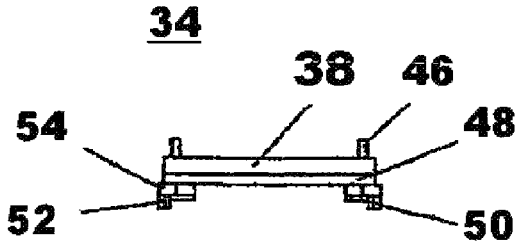
FIG. 3 shows a side view of an exemplary supporting arrangement for fixing a winding former.

FIG. 3 shows a side view of a supporting arrangement, which can be formed by a lateral support 34, for fixing a winding former 12, which can be manufactured to be narrow as a strip 38 or broad as a plate 36, in each case composed of glass-fiber-reinforced plastic, depending on whether it is arranged on the outside or on the inside, as shown in FIG. 1.

The example illustrated in FIG. 3 shows a lateral support 34 which is provided on the outside, in order to support a winding former 12. Its design is as follows. A threaded rod 46 is inserted at each end of the strip 38 which forms the lateral support 34, passing through the strip 38 and a plate located underneath this, consisting of the plate 48, in each case being anchored in a further strip 54, which is arranged at right angles to the strip 38 and is composed of glass-fiber-reinforced plastic.

A plate 50 composed of silicone is in each case provided under these strips 38 which run on both sides of the transformer 10, and a further strip 52 composed of glass-fiber-reinforced plastic is attached to said plate 50.

Figure 4:
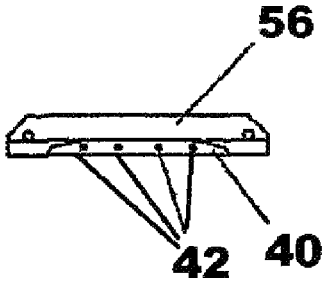
FIG. 4 shows a side view of an exemplary core support.

FIG. 4 shows a side view of a suspension for a core 11 composed of amorphous material. This suspension includes (e.g., consists of) an upper plate 58 composed of silicone, which can be supported by the supporting plate 42 composed of glass-fiber-reinforced plastic. Tie rods 42 pass through the supporting plate 42 composed of glass-fiber-reinforced plastic, itself, interacting with the clamping elements 25, which are not illustrated here, of the upper yoke 22, and being supported thereon.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 Transformer
12 Winding former
14 Electrical connection U
16 Electrical connection V
18 Electrical connection W
20 Connecting conductor
22 Lower yoke
24 Upper yoke

25 Clamping element
26 Web
28 Flange
30 Cross-member
32 Roller
34 Lateral support
36 Plate composed of GFRP
38 Strip composed of GFRP
40 Supporting plate
42 Tie rod
44 Insulator
46 Threaded rod
48 Plate composed of GFRP
50 Plate composed of silicone
52 Plate composed of GFRP
54 Plate composed of GFRP
56 Plate composed of silicone

What is claimed is:

1. A transformer of dry design comprising:

a core in the form of a winding ribbon core composed of an amorphous material, the core being sensitive to mechanical loads;

at least one winding former which surrounds the core and is in each case formed from at least one primary winding and one secondary winding; and at least one holding apparatus configured to fix the at least one primary winding and one secondary winding, the at least one holding apparatus being formed from at least two clamping elements which are operatively connected to one another and act on each end face of the at least one winding former, wherein the core composed of amorphous material is held suspended by the at least one holding apparatus, and wherein the at least one winding former is held independently of the core by the at least one holding apparatus such that mechanical loads applied to at least one of the holding apparatus and the at least one winding former are not subjected to the winding ribbon core.

2. The transformer as claimed in claim 1, wherein the transformer is a polyphase transformer and includes three winding formers with a core.

3. The transformer as claimed in claim 1, wherein at least two winding strip cores are arranged with longitudinal limbs alongside one another, with strip material mechanically connecting the strip cores, wherein the strip material includes amorphous material wound around the strip cores in a winding plane, with all of the limbs having a same winding cross section.

4. The transformer as claimed in claim 1, wherein the clamping elements include ferromagnetic material and serve as a yoke, with the core being magnetically conductively connected to the clamping elements of the holding apparatus.

5. The transformer as claimed in claim 1, wherein end faces of each core include a coating composed of insulating material.

6. The transformer as claimed in claim 4, comprising:

supports which connect the yokes to one another on the end faces of each yoke.

7. The transformer as claimed in claim 6, wherein the supports are passed along external longitudinal sides of at least one of the cores and are surrounded by at least one of the winding formers.

8. A transformer of dry design comprising:

a winding strip core in the form of a winding ribbon core composed of an amorphous material, the core being sensitive to mechanical loads, comprising:

at least one winding former which surrounds the winding strip core and is in each case formed from at least one primary winding and one secondary winding; and at least one holding apparatus, formed from at least two clamping elements for fixing the at least one primary winding and secondary winding, and for acting on each end face of the at least one winding former, wherein the winding strip core composed of amorphous material is held suspended by the at least one holding apparatus, and wherein the at least one winding former is held independently of the winding strip core by the at least one holding apparatus such that mechanical loads applied to at least one of the holding apparatus and the at least one winding former are not subjected to the winding strip core.

9. The transformer as claimed in claim 8, wherein each winding strip core is a ring with at least one of a rectangular, oval or round outline.

* * * * *